US005906495A

United States Patent [19]

Morgan

[11] Patent Number: 5,906,495

[45] Date of Patent: May 25, 1999

[54] ISOLATION TERMINAL

[76] Inventor: Robert Morgan, 25123 Labin La., Parma, Id. 83660

[21] Appl. No.: 09/066,542

[22] Filed: Apr. 24, 1998

[51] Int. Cl.[6] ..... H01R 4/66

[52] U.S. Cl. ..... 439/92; 439/801; 439/521

[58] Field of Search ..... 439/801, 883, 439/100, 92, 521

[56] References Cited

U.S. PATENT DOCUMENTS 3,775,730 11/1973 Rowls ..... 439/755

5,655,936 8/1997 Meredith ..... 439/801

*Primary Examiner*—Gary Paumen

*Assistant Examiner*—Antoine Ngandjui

*Attorney, Agent, or Firm*—Ken J. Pedersen; Barbara S. Pedersen

[57] ABSTRACT

This invention is a secure and long-lasting ground connection, or isolation terminal, for, for example, fiber optic cable installations. The isolation terminal has a proximal end with a hole in a conductive element for receiving a stud extending out from the terminal box, and a nut placed on the stud, or for receiving a bolt placed in the hole for being received by the terminal box. Surrounding and enclosing the conductive element with the hole is a walled structure which is adapted on its lower end to fit and cooperate with the external wall of the terminal box, helping to create a tight seal between the terminal box and the isolation terminal. The inside of the walled structure creates a cavity which is closeable by means of a close-fitting cap, for example. After tightly attaching the isolation terminal to the terminal, the cavity is filled with an insulator, like a dielectric gel, for example, and then the cap is closed to securely cover the cavity. This way, the electrical ground connection is protected against infiltration by the environment and resulting corrosion or decay.

6 Claims, 5 Drawing Sheets

ISOLATION TERMINAL

BACKGROUND OF THE INVENTION

1. Field of the Invention

This invention relates generally to electricity and electrical connectors. More specifically, this invention relates to an isolation terminal for securely connecting an electrical circuit to ground and for securely isolating the connection from the elements, so that the connection will be durable.

2. Related Art

In electrical circuits, it is common to connect the circuit to ground, which is the earth or some conducting body serving in place of the earth. There have been many conventional ways to make this electrical connection to ground. However, in some applications there is a special incentive for a secure and long-lasting ground connection. In fiber optic cable systems, for example, the remoteness and difficult physical environments for many ground connections require that the ground connections be particularly secure and long-lasting. Otherwise, failure of the ground connection will result in poor ability in locating or detecting the fiber optic cable, poor cable in general, service and expensive down-time and repair.

SUMMARY OF THE INVENTION

This invention is a secure and long-lasting ground connection, or isolation terminal, for, for example, fiber optic cable installations. The isolation terminal is an electrical connector which has a proximal end with a hole in a conductive element for receiving a stud extending out from the terminal box, and a nut placed on the stud, or for receiving a bolt placed in the hole for being received by the terminal box. Surrounding and enclosing the conductive element with the hole is an insulated walled structure which is adapted on its lower end to fit and cooperate with the external wall of the terminal box, helping to create a tight seal between the terminal box and the isolation terminal. The inside of the walled structure has a cavity which is closeable by means of a close-fitting cap, for example. After attaching the isolation terminal to the terminal box, the cavity is filled with an insulator, like a dielectric gel, for example, and then the cap is closed to securely cover the cavity. This way, the electrical ground connection is protected against infiltration by the environment and resulting corrosion or decay.

DESCRIPTION OF THE PREFERRED EMBODIMENTS

Figure 1:
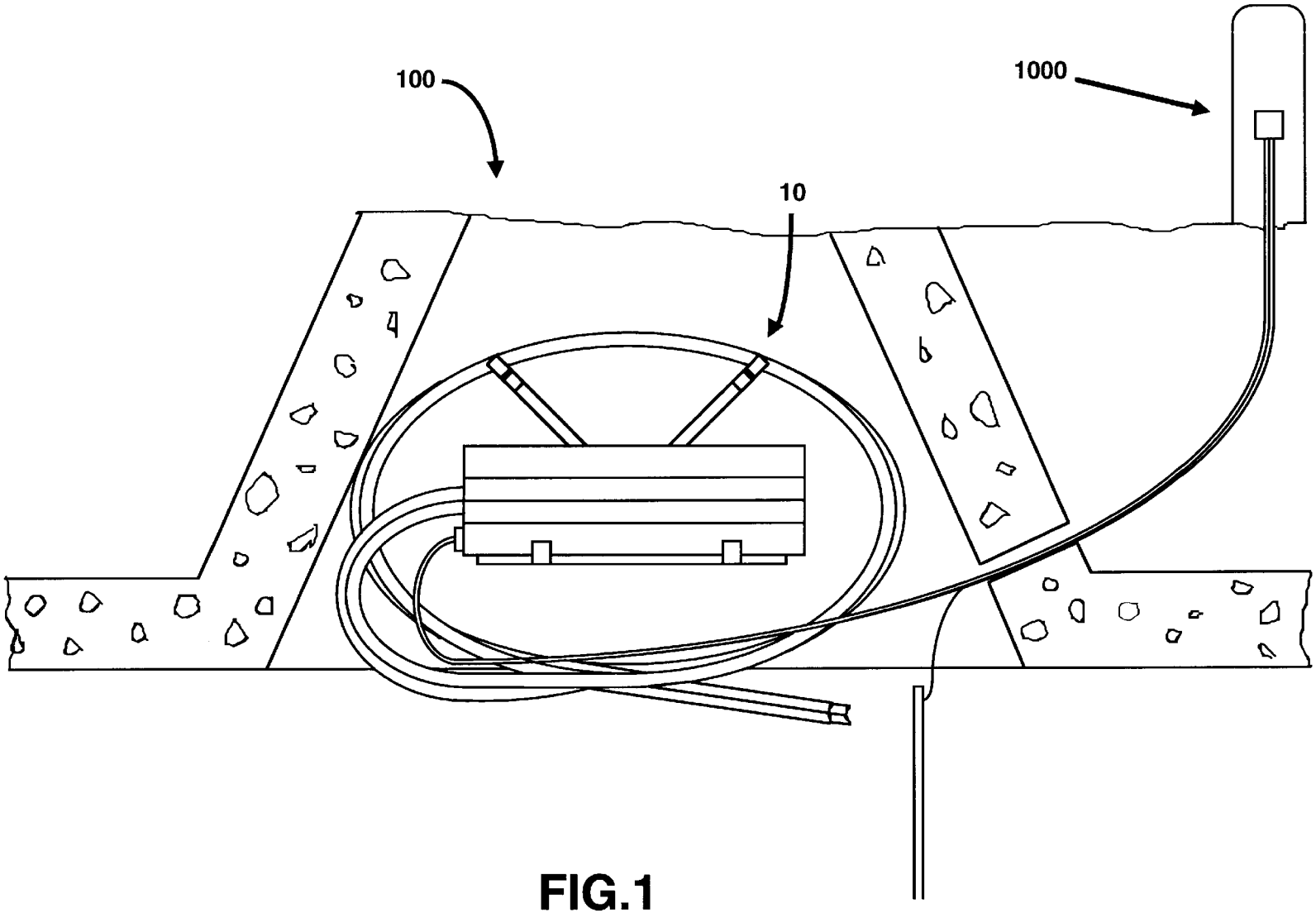
FIG. 1 is a partial cross-sectional side view of a fiber optic cable installation in a manhole with an exemplary ground connection.

Referring to the Figures, there is depicted one, but not the only, embodiment of the present invention. In FIG. 1 there is a view of a fiber optic cable installation 10 in a manhole 100 with an exemplary ground connection 1000.

Figure 2:
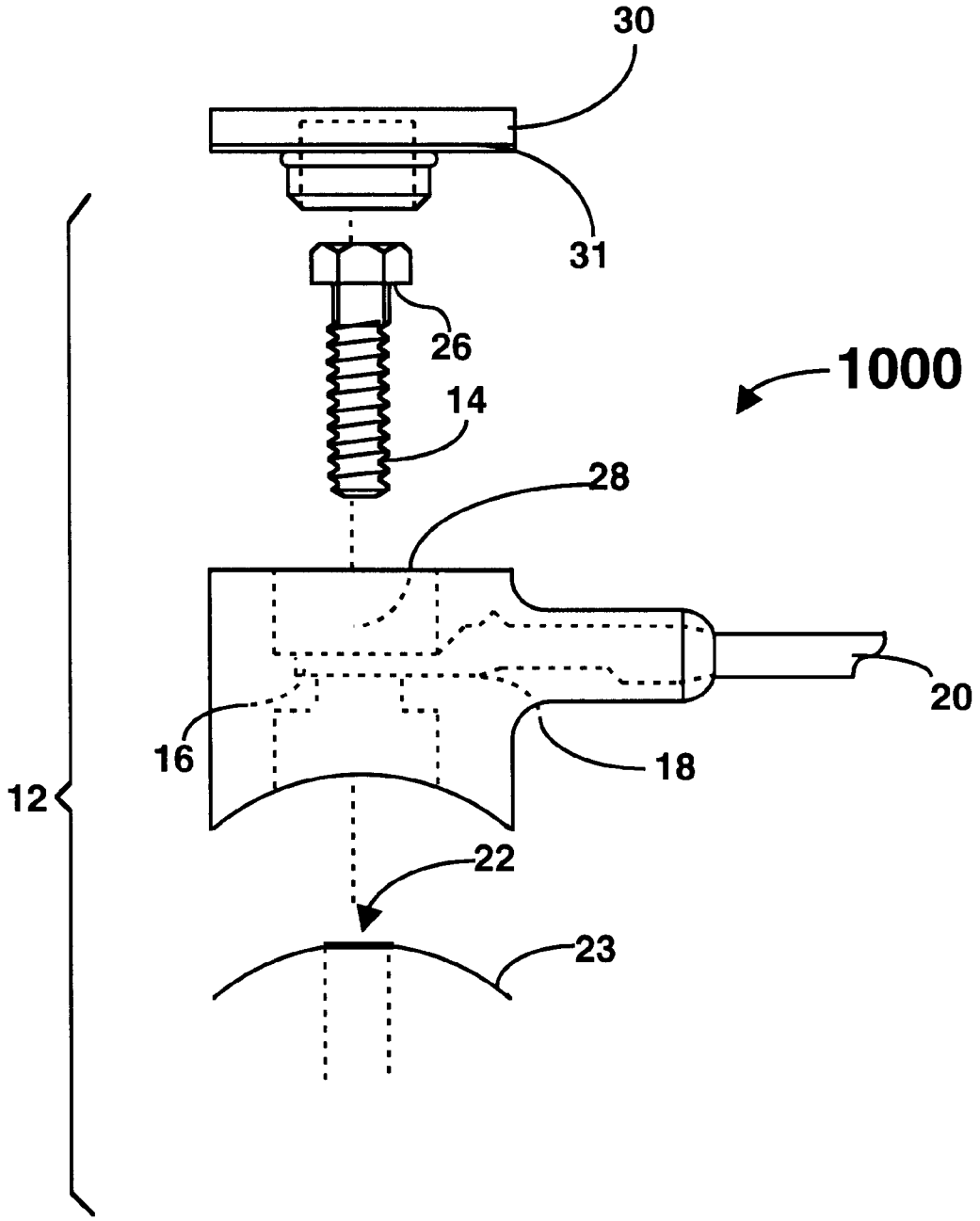
FIG. 2 is a side schematic view of an embodiment of the present invention connected to a terminal box with a hole in its external wall.

In FIG. 2 is a side schematic view of an embodiment 12 of the present invention making up ground connection 1000. Embodiment 12 has a bolt 14 which passes through a cylindrical collar 16. Collar 16 has in its central region a connecting conductive element 18 connected to ground lead 20. Bolt 14 is received by and cooperates with female receptor 22 on terminal box 23 which has a box conductive element 24. When bolt 14 is passed through collar 16 and tightened into receptor 22, the shaft of bolt 14 contacts box conductive element 24. Also, the lower surface 26 of the head of bolt 14 contacts connecting conductive element 18, thus completing the ground circuit among box conductive element 24, bolt 14, connecting conductive element 18 and ground lead 20.

After bolt 14 is completely installed within cylindrical collar 16, the inner space 28 of collar 16 is filled with dielectric gel, and cap 30 is closed to cover the head of bolt 14 and the dielectric gel in inner space 28. Cap 30 may have optional sealing gasket 31, but in any event makes a tight cover of inner space 28. This way, the electrical ground connection is protected against infiltration by the environment and resulting corrosion or decay.

Figure 3:
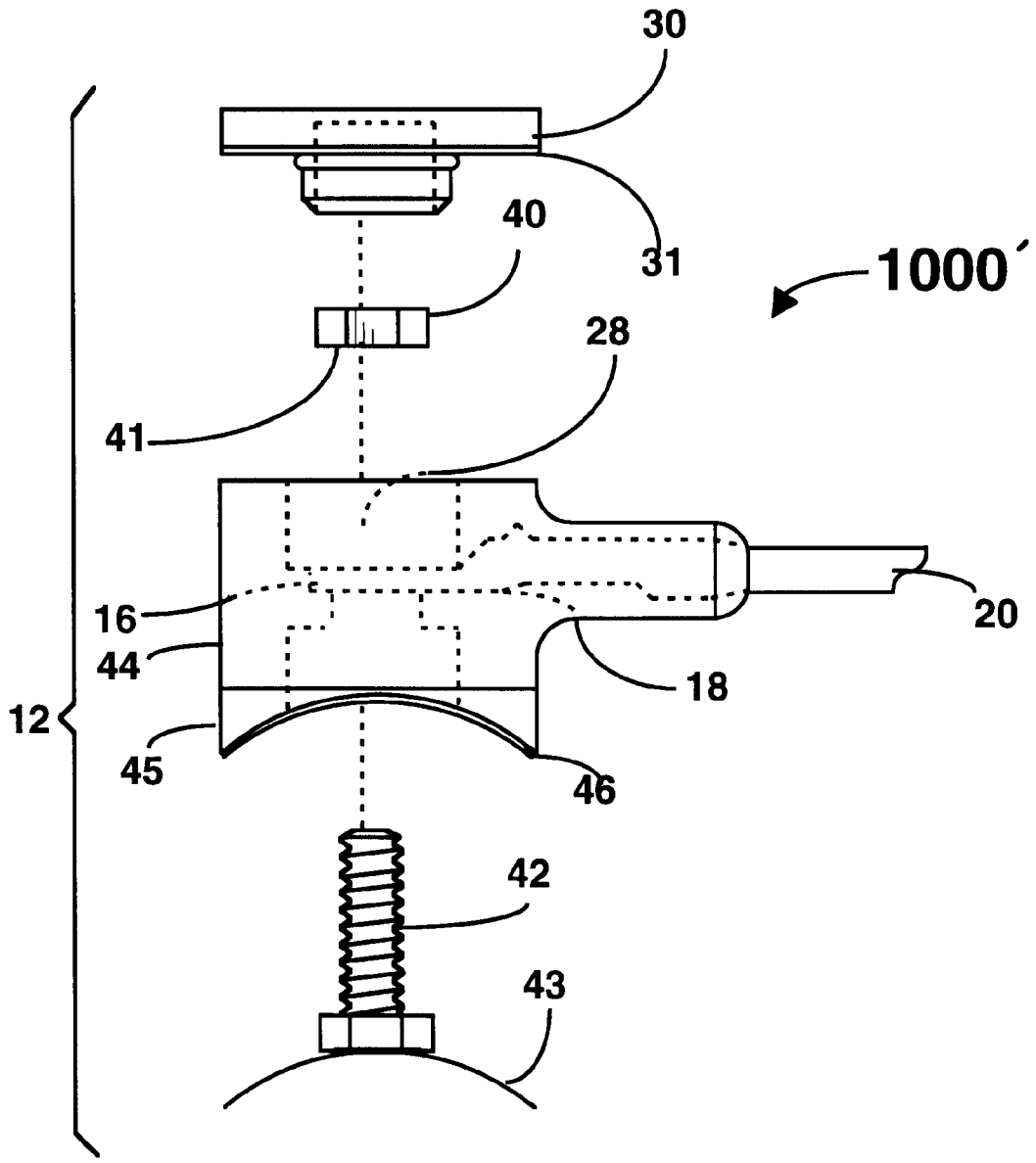
FIG. 3 a side schematic view of an embodiment of the present invention connected to a stud extending out from an external wall of a terminal box.

In FIG. 3 is a side schematic view of an embodiment 12' of the present invention making up ground connection 1000'. Embodiment 12' has a nut 40 which passes over and cooperates with a male stud 42 which is the conductive circuit element extending out from the external wall of terminal box 43. Nut 40 fits within inner space 28' of cylindrical collar 16. As in embodiment 12 discussed above, in embodiment 12' of the present invention stud 42 passes through a cylindrical collar 16. Collar 16 has in its central region a connecting conductive element 18 connected to ground lead 20. Stud 42 on terminal box 43 receives and cooperates with nut 40 to secure collar 16 to terminal box 43. When stud 42 is passed through collar 16 and nut 40 is tightened onto stud 42, the shaft of stud 42 contacts nut 40, and the lower surface 41 of nut 40 contacts connecting conductive element 18. Thus the ground circuit among stud 42, nut 40, connecting conductive element 18 and ground lead 20 is completed.

Collar 16 may be made in several pieces, including top section 44 and bottom section 45. This way, top section 44 may be formed as a universal section, standard for all installations, and bottom section 45 may be formed as an adapter section, differing to be compatible with the external surface for each type of terminal box 43. Also, the isolation terminal may employ an optional gasket 46, between the bottom surface of collar 16, including bottom section 45, and the external surface of terminal box 43.

So, cylindrical collar 16, connecting conductive element 18, ground lead 20, inner space 28 and cap 30 are the same for female receptors 22 (embodiment 12) or male receptors 42 (embodiment 12') on the junction terminal boxes. This way, one style of isolation terminal fits for both applications.

The outside configuration of cylindrical collar 16 may be adapted, particularly on its bottom surface, to accommodate different styles of terminal boxes. Preferably, cylindrical collar 16 is made of a durable material like nylon plastic, for example, to permit a tight compression fit between the collar 16 and the terminal box when the bolt 14 in embodiment 12, or the nut 40 in embodiment 12', are tightened. A slight modulus of elasticity is preferred for collar 16, so that very slight imperfections in the external of the terminal box may be accommodated. However, it is important that collar 16 be stiff and strong enough to maintain its shape indefinitely, continually providing the sealed-off inner space 28 about the electrical connection.

Preferably, connecting conductive element 18 and the proximal tip of ground lead 20 are integrally molded into cylindrical collar 16. Preferably, cap 30 is constructed with close tolerances, for example, approximately ±0.004", so that it creates a tight friction seal with the top of collar 16.

Figure 4:
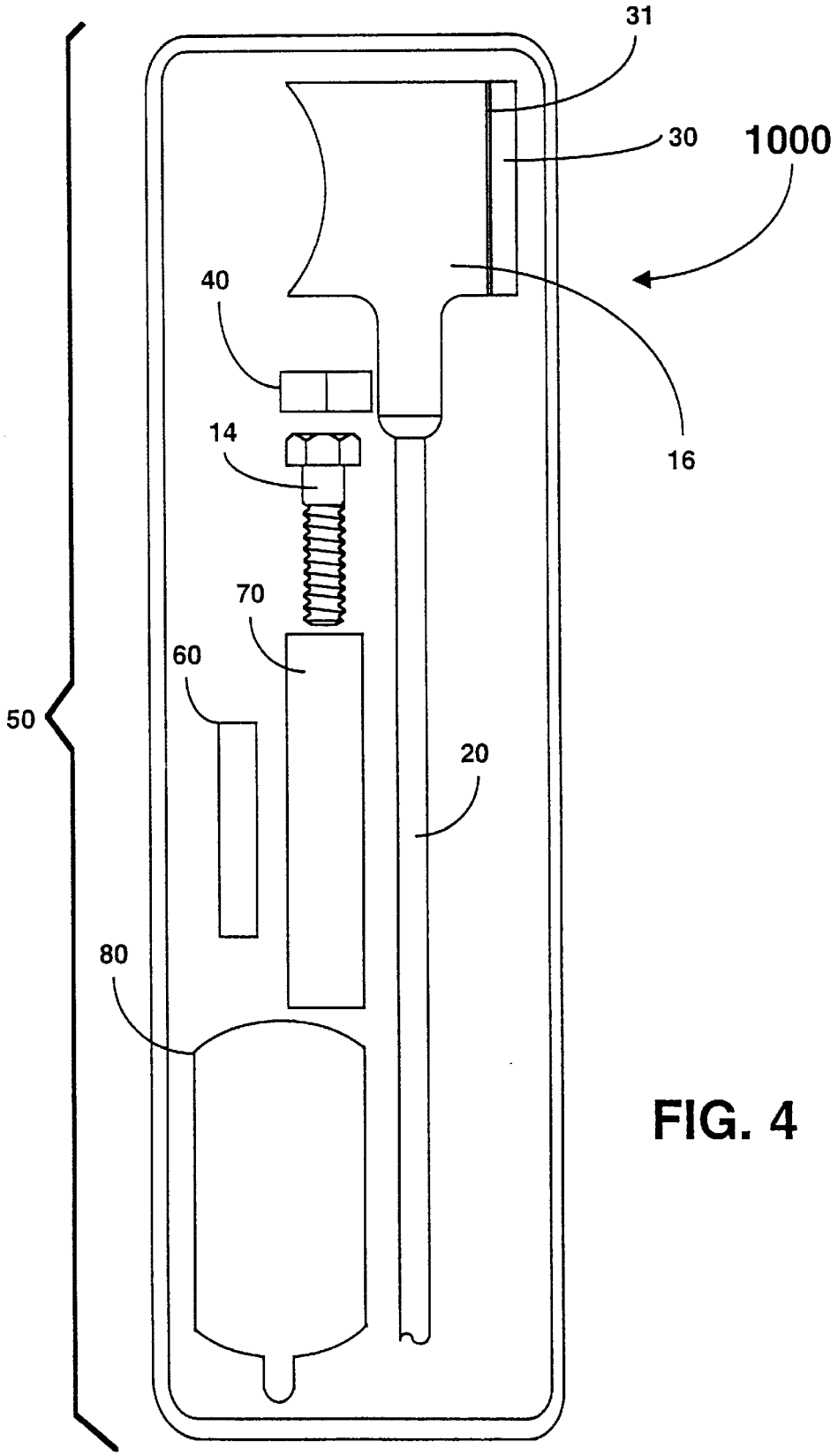
FIG. 4 is a top view of a kit collection of an embodiment of the present invention, including several accessory pieces.

In FIG. 4 is a top view of a kit collection 50 of an embodiment of the invention. In the kit 50 are cylindrical collar 16, cap 30 with optional gasket 31 and integral ground lead 20. Also provided are bolt 14 (for female receptors) and nut 40 (for male receptors). Also provided are metal crimp connector 60, rubber heat shrink sleeve 70 and squeeze tube of dielectric 80. To use the kit, ground lead 20 is first connected to the existing ground wire (not shown) by crimp connector 60 in conventional fashion. Then, heat shrink sleeve 70, previously being slid over the existing ground wire, is slid over the crimp connection and heated to melt it securely in place. Then, cylindrical collar 16 is placed over the connection to the terminal box. If the connection is female, bolt 14 is screwed into it. If the connection is male, nut 40 is screwed onto it. Then, a dielectric gel from squeeze tube 80 is filled in the inner space 28 of collar 16 and the cap 30 is firmly placed over it.

Figure 5:
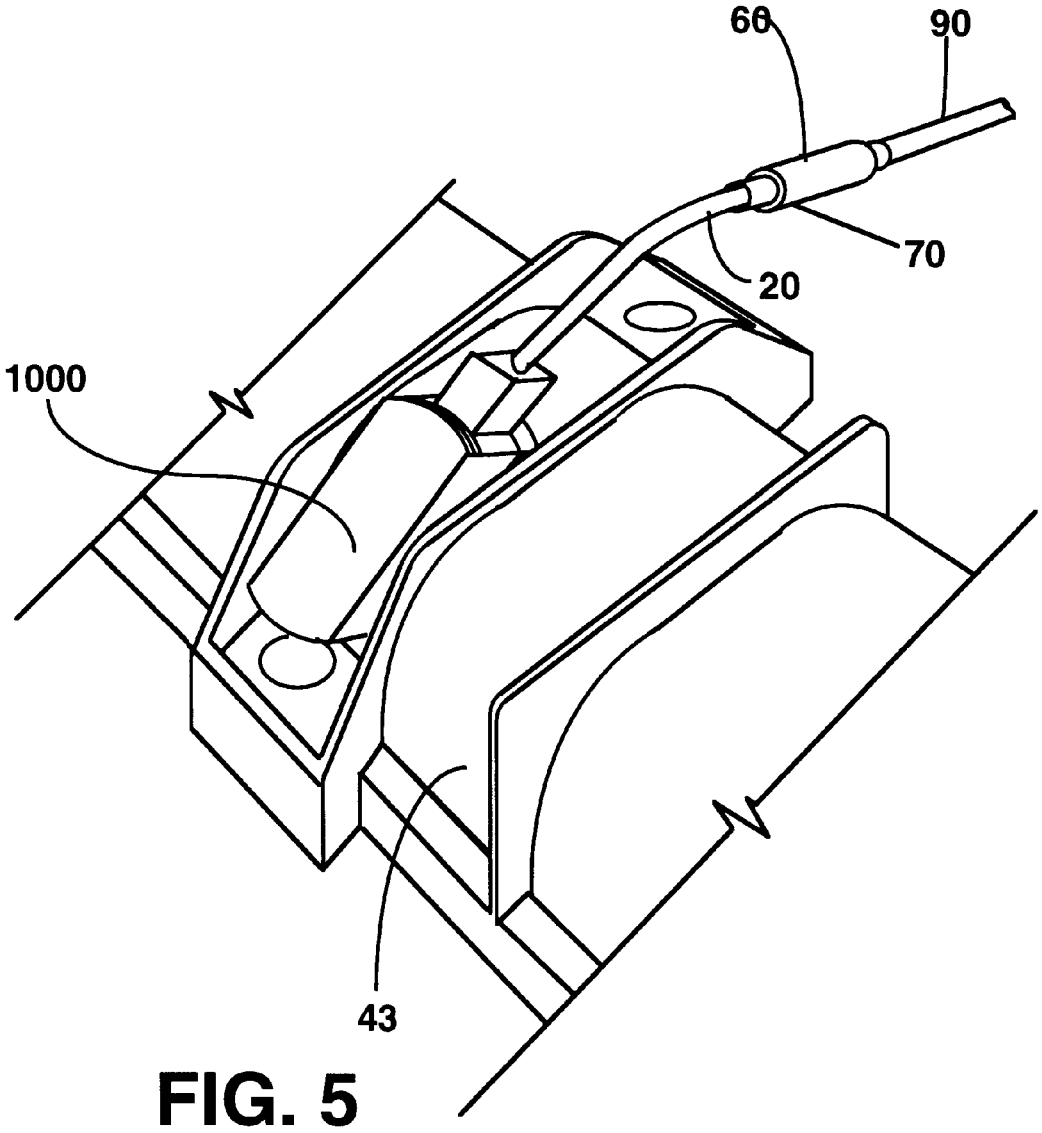
FIG. 5 is a partial perspective view of an embodiment of the present invention connected to a terminal box.

An installed embodiment of the present invention is depicted in FIG. 5. There the ground connection 1000 is connected to the external wall of terminal box 43. Ground lead 20 extends distally from box 43, and has in it crimp connector 60 covered by heat sink sleeve 70 to provide a secure and long lasting connection to ground wire 90.

Although this invention has been described above with reference to particular means, materials and embodiments, it is to be understood that the invention is not limited to these disclosed particulars, but extends instead to all equivalents within the scope of the following claims.

I claim:

1. An isolation terminal, comprising:

an electrically-insulating walled structure with an inner space having an upper cavity with an upper opening and a lower cavity with a lower opening;

an electrical conductor with a hole in it, the conductor being received inside the inner space between the upper cavity and the lower cavity and being connected to a ground lead exiting the walled structure;

the walled structure having a bottom surface which is adapted to cooperate with the external surface of a terminal junction box, thereby creating a tight seal with the junction box;

an electrically-conductive fastening means, adapted to fit within and be surrounded by the inner space of said walled structure, the fastening means passing through the hole in said electrical conductor, contacting the electrical conductor, and adapted to connect to the junction box;

the isolation terminal further comprising a cap removably attached to the walled structure across the upper opening, the cap entirely closing the upper opening and having a seal contacting the walled structure and forming a liquid-tight seal between the cap and the walled structure.

2. An isolation terminal as in claim 1, further comprising insulator material received in the upper portion.

3. An isolation terminal as in claim 2, wherein the insulator material is a dielectric gel.

4. An isolation terminal as in claim 1, further comprising a gasket against the bottom surface of the walled structure for sealing the bottom surface to the external surface of the terminal junction box.

5. An isolation terminal as in claim 1, wherein the fastener comprises a nut and bolt with a head, and wherein the upper cavity and the lower cavity are both adapted in size to receive the head of the bolt.

6. An isolation terminal as in claim 1, wherein the cap has a central projection which is received in the upper cavity and sealingly contacts the inner wall of the walled structure.

* * * * *